US005077854A

United States Patent [19]

Moons

[11] Patent Number: 5,077,854

[45] Date of Patent: Jan. 7, 1992

[54] APPARATUS FOR AUTOMATICALLY CLEANING AND DISPENSING GOLF BALLS

[76] Inventor: Wilhelmus A. Moons, Watersnip 47, Bodegraven 2411 MB, Netherlands

[21] Appl. No.: 353,637

[22] PCT Filed: Oct. 1, 1987

[86] PCT No.: PCT/NL87/00025

§ 371 Date: Mar. 28, 1989

§ 102(e) Date: Mar. 28, 1989

[87] PCT Pub. No.: WO88/02270

PCT Pub. Date: Apr. 7, 1988

[30] Foreign Application Priority Data

Oct. 3, 1986 [NL] Netherlands ..... 8602503

[51] Int. Cl.[5] ..... A63B 47/04

[52] U.S. Cl. ..... 15/21.2; 15/3.11; 15/3.17; 134/83; 134/133

[58] Field of Search ..... 15/3.11, 3.12–3.18, 15/21.2; 134/83, 133

[56] References Cited

U.S. PATENT DOCUMENTS 527,590 10/1894 Carlson ..... 15/21.2 X
1,055,121 3/1913 Becker ..... 15/21.2 X
3,733,633 5/1973 Gustafson ..... 15/21.2
3,820,183 6/1974 Gustafson et al. ..... 15/21.2

FOREIGN PATENT DOCUMENTS 1037916 4/1978 Canada ..... 221/10
0167470 1/1986 European Pat. Off. .

*Primary Examiner*—Edward L. Roberts
*Attorney, Agent, or Firm*—Hayes, Soloway, Hennessey & Hage

[57] ABSTRACT

The invention provides an apparatus for automatically cleaning and dispensing golf balls. The apparatus has a supply chute which connects to a cleaning apparatus and to a gravity operated sorting apparatus which incorporates a dispensing apparatus which feeds a predetermined number of golf balls to an outlet. According to the invention, the sorting apparatus comprises a downwardly sloping barred-grating onto which the golf balls fall from a supply-chute and over which they roll in rows to the dispensing apparatus. In a preferred embodiment of the invention, the dispensing apparatus has a row of apart-lying cams which can move upward to their operating positions between the rods of the ball-grating to lift a predetermined number of balls from rows of balls lying on the rods and allow them to fall into the outlet while in their rest positions and cams remain free of the balls lying on the ball-grating.

32 Claims, 2 Drawing Sheets

APPARATUS FOR AUTOMATICALLY CLEANING AND DISPENSING GOLF BALLS

The Apparatus is provided with a supply chute connected to a cleaning apparatus and a gravity operated sorting apparatus incorporating a dispensing apparatus which dispenses a predetermined number of golf balls to an outlet.

Apparatus of this type is known from DE-A-3425653. In the arrangement described therein, balls are transported to a washbasin one-by-one through a perforated tube, washed, and then lifted to a row of ducts arranged vertically side-by-side and from which they can be removed at the bottom in a predetermined number as required by an ejecting mechanism. The first objection to this apparatus is that the operating speed is limited because the tube can only transport one ball at a time. Secondly, the separate washbasin occupies a relatively large space. Thirdly, the upwardly and downwardly moving tube requires a driving system which can reject a damaged ball or alien objects such as stones, twigs, pine-cones and the like which come mainly with machine collected balls from which they cannot be sorted and which may clog the tube. Fourthly, washing in a perforated tube is not particularly efficient so that the balls fall insufficiently cleaned into the ducts which can gradually become fouled up so that these too become clogged. Fifthly, the ejecting mechanism does not operate faultlessly in combination with the integers causing the other objections so that the same number of balls are not dispensed each time.

It is the object of the invention to remove these objections and to provide a compact, reliably operating apparatus which constantly dispenses the same predetermined number of well-cleaned golf balls and sorts out damaged balls or alien objects.

According to the invention the sorting apparatus comprises a downwardly-sloping ball-grating having spaced apart grating bars onto which the golf balls fall from a supply chute and over which they roll in rows to a dispensing apparatus.

It is to be noted that the golf ball dispensing apparatus of EPA-A-0.167 and CA-A-1.0379.916 does dispense a predetermined number of golfballs but the cleaning apparatus is lacking however.

This presents a great objection when balls are to be handled by the machine in an uncleaned condition, especially when they are fouled with clay or another easily adhering soil specie or when they have to be cleaned by a separate cleaning apparatus. In the apparatus according to EP-A-0.167 nand that of CA-A-1.0379.916. the balls move through completely or partially closed ducts and are supported in the centres on their undersides by a completely closed baseplate. As opposed to this arrangement, in the present invention the balls are supported on both sides off-centre on the bars of the grating. Through this arrangement, the adhering dirt is removed from the balls and can fall easily through the bars whilst the ball-lift can operate upward between the bars to lift the balls therefrom.

The invention is now to be described further with reference to the accompanying drawings of one embodiment of the invention.

Figure 1:
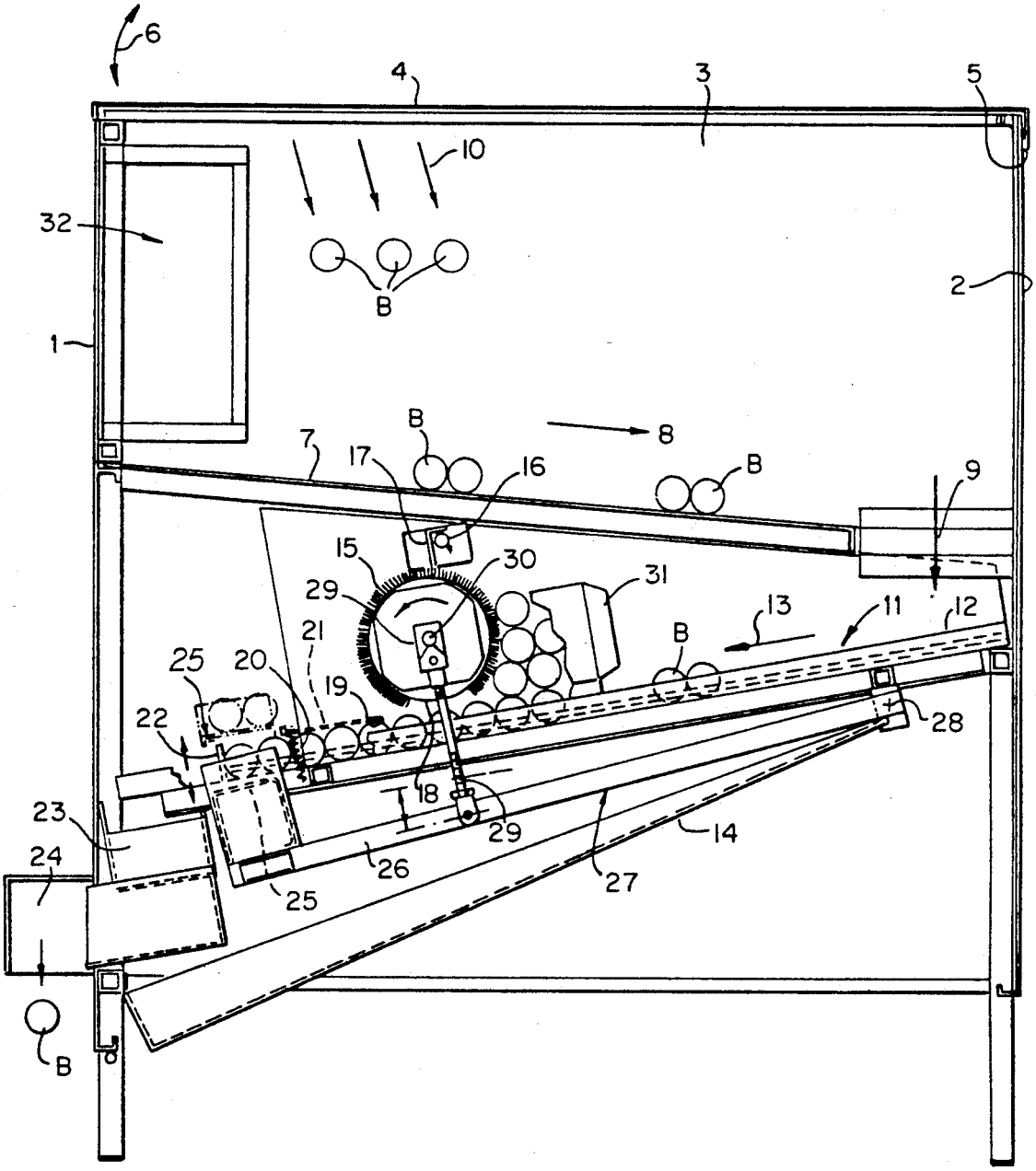
FIG. 1 shows a part-sectioned side elevation of the apparatus according to the invention.
Figure 2:
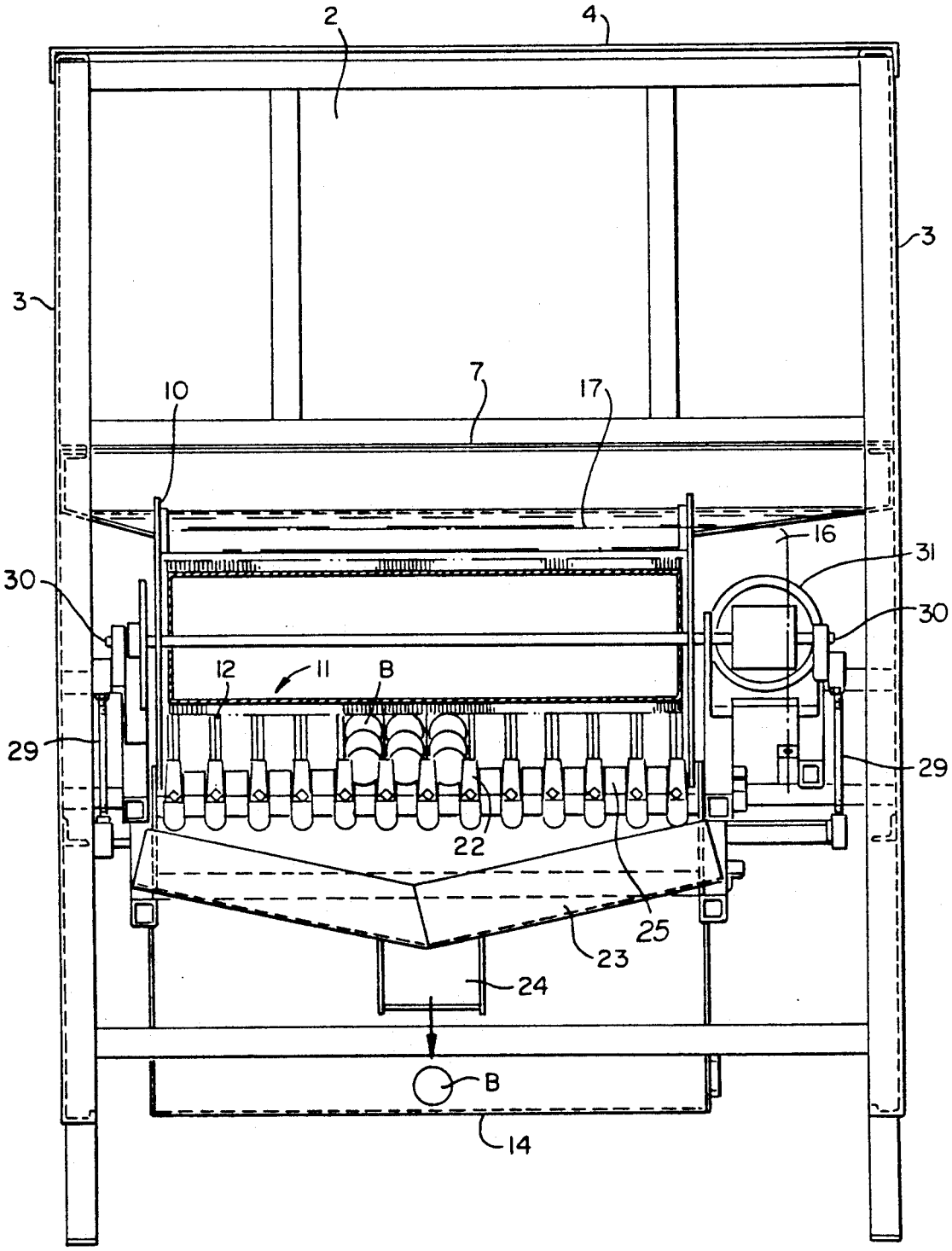
FIG. 2 shows a front elevation of the apparatus of FIG. 1.

The drawings show an apparatus provided with a frame of tubular sections which is further provided with a housing formed by sheet material. This housing has a front wall 1, a rear wall 2 and sidewalls such as 3 (one of which is not visible), and a lid 4 which is hinged on a horizontally arranged hinge 5. The balls B to be cleaned and the thereafter to be dispensed number thereof can be discharged into the housing 1 to 5 in the direction indicated by the arrow 10 through the space vacated by the lid 3 when the latter is swung open in the direction indicated by the arrow 6. The balls B fall onto the ball-plate 7 which slopes downward to the right a shown in FIG. 1 and which, together with the rest of the upper parts of the housing 1 to 3, forms a supply chute 8 with the bottom outlet 9. The balls rolling down the ball-plate 7 fall through the outlet 9 whereafter they again fall onto the underlying leftwardly-sloping ball-grating generally indicated by the reference numeral 11. This ball-grating 11 is built up from a row of parallel-lying bars 12 which are arranged at equal pitch-distances S from one another and in such a manner that the balls roll therealong in rows in the direction indicated by the arrow 13. With this arrangement, damaged balls and alien objects such as stones, twigs, pine-cones and the like which come therebetween mainly with machine collected balls, are sorted by the grating 11 and fall therethrough into a dirt-collecting tray 14.

The balls B then collect directly in front of an anti-clockwise rotating cylindrical cleaning-brush 15 which is preferably provided with sprayer-pipeline 16 for carrying a cleaning liquid, and then brushed clean. The dirty liquid flowing away is collected at the same time by a dirt-collecting tray 14. The sprayer pipeline 16 is affixed in position above the brush 15 to a transversely arranged scraper-bracket 17 the lower edge of which scrapes against the upper peripheral surface of the brush 15 and removes any strongly adhering dirt which may be clinging to the latter. The upper edge of the scraper-bracket 17 joins the underside of the ball-plate 7 so that no ball is permitted to pass the brush in an uncleaned state to the discharge point. The cylindrical brush 15 has bristle-free sector 18 which is shown only in rest position in FIG. 1. and in which position it allows the cleaned balls to roll free thereunder. Dirty balls of the pile of balls shown to the right of the brush 15 in FIG. 1 are moved about with respect to one another by the movement of the brush 15 and distributed horizontally so that with sufficient quantities of dirty balls in front of the brush 15, the balls B are continuously fed to all the grating-bars 12. Above the grating 11 and to the left of the brush 15, a coverplate 21 is arranged to pivot vertically about the axis of a horizontal shaft 19 to which it is affixed and against the action of a spring 20. This coverplate 21 ends at some distance from the end of the grating 11 and allows the part therebetween to remain uncovered.

The balls which pass under the lower end of cover plate 21 come to rest against a stop 22. They are then in a position to be lifted to the dotted line position shown in FIG. 1 so that the balls will roll over the stop 22 and will fall into the discharge chute 23 connected to the outlet 24. On one hand, the coverplate 21 is destined to only permit a predetermined number of horizontal rows of balls to be located above the ball-lifter. On the other hand, the spring-loaded coverplate 21 exerts a spring action to counter seizure of the ball-lifter should the balls not come entirely free from the coverplate and such as when a damaged ball or alien object remains lying on the grating and has obstructed the regular flow of the balls lying thereon or when the dispensing apparatus is blocked for example or for other reasons.

The ball-lifter comprises a row of cams 25 arranged a like distance or a pitch S apart and which can move between the rods 12 of the ball-grating 11 to lift the balls lying on the latter and so that they can fall into the discharge chute 23. Each of the cams 25 has a substantially flat upper surface which, in the cam's highest operating position assumes an angle which is just as great as that of the bars of ball-grating 11 and through which the leftward roll-off of the balls illustrated in FIG. 1 is assisted. The cams 25 are each affixed to a rod 26 which, together with a cam-grating generally indicated by the reference numeral 27, form parallel arranged bars which are arranged beneath the ball-grating 11 but above the dirt-collecting tray 14 and which allow dirt and liquid to fall therebetween. The cam-grating 27 is hinged at its upper right-lying end to enable it to pivot around the axis of a horizontally arranged shaft 28 and is pivotably movable upward to an ejecting position and downward to a rest position the last of which is shown in full lines in FIG. 1.

The cam-grating 27 is driven in its pivoting action by a crank mechanism 29 from the shaft 30 of the cylindrical brush 15 which is in turn driven by an electromotor 31.

Preferably, the apparatus is started by the coin/token-operated mechanism 32 shown schematically in FIG. 1. and into which the user can insert a predetermined number of coins/tokens and after which the ball-lift is set into motion by the electromotor 31. The brush 15 is started at the same time but can also work separately without dispensing balls by the use of a declutchable coupling (not shown) and which is fitted between the shaft 30 and the crank mechanism 29.

The invention is not limited to the illustrated embodiment but can also have many variations. For example, the ball-lift can also be driven in an entirely different manner than by the crank mechanism, added to which the cams can be accommodated on a rotating camshaft or plain shaft.

I claim:

1. In apparatus for automatically cleaning and dispensing golf balls which is provided with a supply chute connected to apparatus for cleaning dirt from the golf balls and a gravity operated sorting apparatus incorporating a dispensing apparatus which dispenses a predetermined number of golf balls to an outlet, the improvement wherein the sorting apparatus comprises a downwardly-sloping ball-grating (11) having spaced apart grating bars (12) onto which the golf balls (B) fall from a supply chute (1,2,3,7) and over which they roll in rows to a dispensing apparatus, a cleaning apparatus positioned adjacent to said ball-grating to remove dirt from said golf balls, said grating bars permitting passage of dirt removed from the balls in the cleaning apparatus.

2. Apparatus as claimed in 1, wherein a plate (21) is arranged above at least a part of a discharge section of the lower part of the ball-grating (11) and which together with the grating-bars (12) forms a number of channels through which the balls on any pair of bars can pass only in single file so as to prevent the balls piling up thereon.

3. Apparatus as claimed in claim 1 wherein the dispensing apparatus comprises a row of spaced apart cams (25) constituting a cam grating (27) which in their rest positions are below the bars (12) and in their operating positions can move upward into spaces between the bars (12) of the ball-grating (11) and by means of which a predetermined number of the golf balls (B) lying in rows on the bars (12) can be lifted and allowed to fall into the outlet whilst in their rest positions the cams remain free of the balls lying on the ball-grating (11) and means are provided for lifting said cams (25) on the cam grating from their rest positions to their operating positions.

4. Apparatus as claimed in claim 3 wherein the cams (25) have a flat upper surface of which their angle-of-inclination in their operating position is at least equal to that of the bars of the ball-grating (11).

5. Apparatus as claimed in claim 4, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

6. Apparatus as claimed in claim 5, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

7. Apparatus as claimed in claim 3 wherein the cams (25) between the bars (12) of the ball-grating (11) move at the locations of the balls directly in front of a stop element (22).

8. Apparatus as claimed in claim 7, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

9. Apparatus as claimed in claim 3 wherein each of the cams (25) are affixed to a rod (26) and which together form the cam-grating (27) which pivots about the axis of a shaft (26) which is fixed underneath the ball-grating (11) and which said cam-grating (27) can pivot between a rest position in which the cams (25) remain free of the balls (B) lying on the discharge part of the ball-grating (11) and a working position in which the cams (25) are moved between the bars (12) of the ball-grating (11) from where they push off a predetermined number of the lowermost balls therefrom.

10. Apparatus as claimed in claim 9 wherein the cam-grating (27) is connected to the driving shaft (29) of a crank mechanism (30) which can move the cam-grating (27) between the working position and the rest position.

11. Apparatus as claimed in claim 10 wherein the crank driving-mechanism (29, 30) is located above the ball-grating (27).

12. Apparatus as claimed in claim 11, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

13. Apparatus as claimed in claim 10, characterized in that a drive shaft (30) of the crank mechanism carries a cylindrical cleaning brush (15) of which the lower surface to be contacted with the balls (B) rotates counter clockwise in a direction opposite to that of the downward movement of the balls (B) over the ball-grating (11) and in which the balls (B) lying on the ball-grating (11) can be brought into contact with the cleaning brush

(15) for brushing off strongly adherent dirt clinging thereto.

14. Apparatus as claimed in claim 13, characterized in that the cylindrical cleaning brush (15) has a bristle-free peripheral portion (18) under which the balls (B) on the ball-grating (11) can move to the discharge part of the ball-grating (11) without being contacted by the cleaning brush (15).

15. Apparatus as claimed in claim 14, characterized in that the cylindrical cleaning brush (15) is provided with liquid-supply pipeline (16) for improving the cleaning process of the golfballs (B).

16. Apparatus as claimed in claim 15, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

17. Apparatus as claimed in claim 14, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

18. Apparatus as claimed in claim 13, characterized in that the cylindrical cleaning brush (15) is provided with liquid-supply pipeline (16) for improving the cleaning process of the golfballs (B).

19. Apparatus as claimed in claim 18, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

20. Apparatus as claimed in claim 13, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

21. Apparatus as claimed in claim 10, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

22. Apparatus as claimed in claim 9, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

23. Apparatus as claimed in claim 3, characterized in that each of the cams (25) are affixed to a rod (26) and which together form said cam-grating (27) which pivots about the axis of a shaft (26) which is fixed underneath the ball-grating (11) and which said cam-grating (27) can pivot between a rest position in which the cams (25) remain free of the balls (B) lying on or rolling over a discharge part of the ball-grating (11) and a working position in which the cams (25) are moved between the bars (12) of the ball-grating (11) from where they have pushed off a predetermined number of the lowermost balls (B) therefrom.

24. Apparatus as claimed in claim 23, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

25. Apparatus as claimed in claim 3, characterized in that a dirt-collecting try (14) is fitted beneath the ball-grating (11) and the cam-grating (27) and in which damaged balls and adherent dirt removed from the balls, alien objects and contaminated washing liquid and such like can be collected.

26. Apparatus as claimed in claim 25, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

27. Apparatus as claimed in claim 3, characterized in that a first-collecting tray (14) is fitted beneath the ball-grating (11) and the cam-grating (27) and in which damaged balls and adherent dirt removed from the balls, alien objects and contaminated washing liquid and such like can be collected.

28. Apparatus as claimed in claim 27, characterized in that a dirt-collecting tray (14) is fitted beneath the ball-grating (11) and the cam-grating (27) and in which damaged balls and adherent dirt removed from the balls, alien objects and contaminated washing liquid and such like can be collected.

29. Apparatus as claimed in claim 1 wherein the cleaning apparatus includes a ball rotatable cylindrical-brush (15) positioned adjacent the ball-grating (11) so that balls rolling down the grating can be brought into contact with the brush for brushing off strongly adherent dirt clinging thereto.

30. Apparatus as claimed in claim 29 wherein the cylindrical-brush (15) has a bristle-free peripheral portion (18) under which the balls on the ball-grating (11) can move to the discharge part.

31. Apparatus as claimed in any one of claims 29 and 30 wherein the cylindrical-brush (15) is provided with liquid-supply pipeline (16) for improving the cleaning process.

32. Apparatus as claimed in claim 1 wherein a dirt-collecting tray (14) is fitted beneath the ball-grating (11) and the cam-grating tray (14) is fitted beneath the ball-grating (11) and the cam-grating (27) and in which damaged balls and adherent dirt removed from the balls, alien objects and contaminated washing liquid and such like can be collected.

* * * * *